United States Patent [19]

Best

[11] Patent Number: 4,546,802

[45] Date of Patent: Oct. 15, 1985

[54] AUTOMATIC FAILURE SENSOR FOR HOT WIRE CUTTERS

[75] Inventor: Robert H. Best, Greensboro, N.C.

[73] Assignee: Burlington Industries, Inc., Greensboro, N.C.

[21] Appl. No.: 616,684

[22] Filed: Jun. 4, 1984

[51] Int. Cl.[4] ..... D03D 51/00

[52] U.S. Cl. ..... 139/336; 66/157; 112/290; 139/302

[58] Field of Search ..... 112/290; 139/302, 303, 139/429, 336 R, 291 C; 26/82; 156/515, 517, 518, 522; 66/163, 157

[56] References Cited

U.S. PATENT DOCUMENTS

| | | | |
|---|---|---|---|
| 2,588,689 | 3/1952 | Antonevich | 66/157 |
| 3,128,797 | 4/1964 | Valley | 139/302 |
| 3,142,279 | 7/1964 | Rubin . | |
| 3,188,992 | 6/1965 | Freeman et al. . | |
| 3,346,018 | 10/1967 | Kohler | 139/336 R |
| 3,977,441 | 8/1976 | Svaty | 139/336 R |

FOREIGN PATENT DOCUMENTS

| | | | |
|---|---|---|---|
| 47-12213 | 4/1972 | Japan | 139/302 |

*Primary Examiner*—Henry S. Jaudon

*Attorney, Agent, or Firm*—Cushman, Darby & Cushman

[57] ABSTRACT

In order to prevent a loom from continuing to operate after burnout of hot wire cutters for cutting selvage, circuitry is provided to automatically stop operation of the loom upon hot wire cutter burnout. The circuitry preferably includes a conventional loom-stopping device associated with drop wires (for detecting warp end breakage) already associated with the loom. A coil is disposed in series with the hot wire cutters and operatively associated with a reed switch and an indicator light which are connected in parallel with the drop wires. The coil, reed switch, and indicator light can be readily retrofit to pre-existing loom components, and the indicator light allows the operator to determine whether loom stoppage is a result of hot wire cutter burnout, or warp end breakage.

20 Claims, 3 Drawing Figures

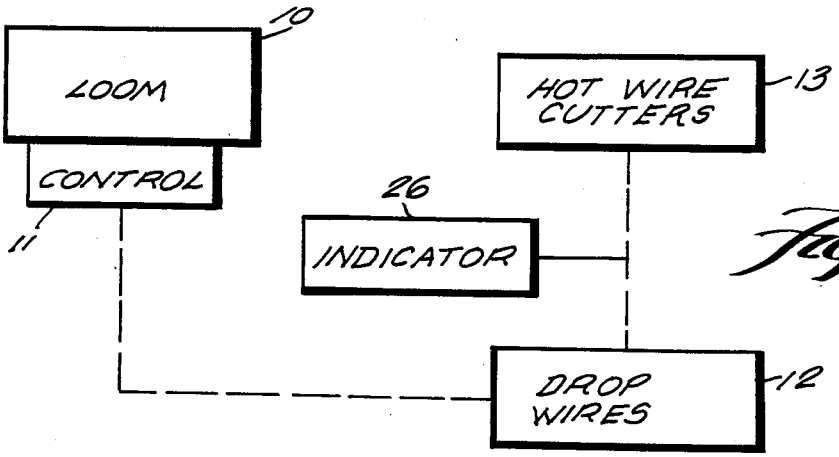
Fig. 1
Fig. 2
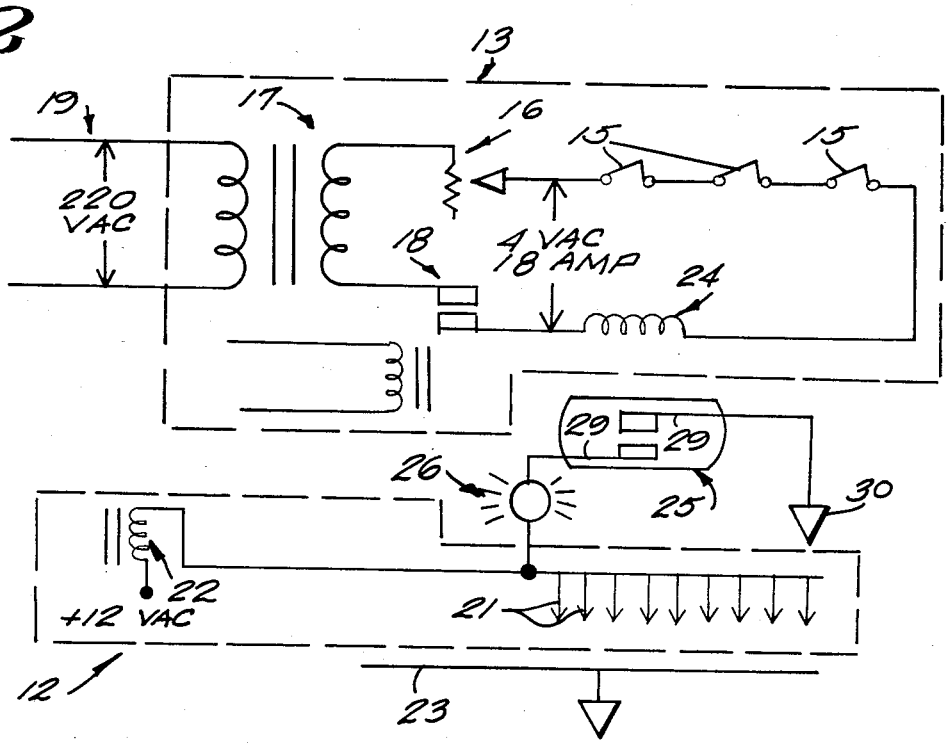
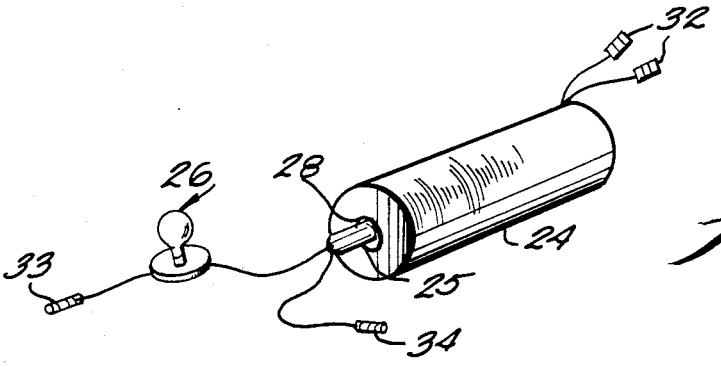
Fig. 3

AUTOMATIC FAILURE SENSOR FOR HOT WIRE CUTTERS

BACKGROUND AND SUMMARY OF THE INVENTION

In the weaving art, particularly for the weaving of glass fibers, and like textile materials, hot wire cutters are utilized to trim the selvage edges of the fabric being produced. The cutters are typically supplied with low voltage and high current, and there is a tendency for the cutters to burn out from the intense heat at which they operate. When a cutter wire burns out there is no immediately apparent indication that such an event has occurred, and the loom continues to weave fabric, but with a rough selvage. Since each operator typically has a number of looms that he/she is responsible for (typically 50–200 looms), a given loom may continue to weave for a long period of time before the burned out cutter wire is detected, resulting in the production of fabric with unacceptable selvage.

According to the present invention, a structure, and method, are provided to ensure that unacceptable selvage fabric—as a result of cutter wire burnout—will not be produced. According to the invention, the loom is automatically stopped whenever a cutter wire burns out, or is otherwise disabled.

In the preferred embodiment of the invention, a minimum number of components are utilized in order to effect loom stoppage as a result of cutter wire failure. A conventional loom typically includes a plurality of drop wires, each of which is associated with a warp end on the loom. The drop wires detect warp end breakage, and are conventionally connected to a knock-off solenoid which effects loom stoppage upon warp end breakage. According to the preferred embodiment of the invention, a few simple electrical components are interconnected between the cutter wire circuitry and the drop wire circuitry, so that the same loom-stoppage mechanism stops loom operation as a result of either cutter wire failure or warp end breakage—yet the operator can readily distinguish which of the two events has caused the loom stoppage.

The preferred embodiment of the invention includes a coil which is connected in series with the hot wire cutters, and which has a hollow core. A conventional reed switch, which has the contacts thereof normally biased to a closed position (but which open under the influence of the coil) is inserted into the core of the coil, and the reed switch and an indicator light (or like indicating means) are connected in parallel with the drop wires. When a cutter wire fails, the coil is deenergized, the reed switch contacts close, the indicator light goes on, and the knock-off solenoid stops operation of the loom. By inspecting the light the operator readily can determine that loom stoppage was a result of cutter wire failure, and then proceed to correct the problem. If the loom stops and the indicator light is not lit, then the operator knows that loom stoppage was the result of warp end breakage.

It is the primary object of the present invention to provide for the simple and effective stoppage of a loom (or other device) as a result of hot wire cutter failure. This and other objects of the invention will become clear from an inspection of the detailed description of the invention, and from the appended claims.

BRIEF DESCRIPTION OF THE DRAWINGS

FIG. 1 is a block diagram indicating the operative relationship between exemplary components of a combination according to the invention;

FIG. 2 is a circuit diagram illustrating a preferred combination according to the invention; and FIG. 3 is a perspective schematic view of particular electrical components according to the present invention that may be retrofit to a pre-existing conventional loom.

DETAILED DESCRIPTION OF THE DRAWINGS

A conventional loom 10 (see FIG. 1), such as a Sulzer-Ruti, has a control 11 associated therewith for stopping operation of the loom should warp ends on the loom break. A drop wire assembly 12 detects warp end breakage, and effects operation of the control 11 in response thereto.

A conventional loom also includes a hot wire cutter assembly 13, the hot wire cutters effecting trimming of the selvage of the fabric being woven by the loom 10. According to the present invention, should a hot wire cutter associated with the assembly 13 fail, stoppage of the loom will be effected, and the preferred embodiment of the invention provides an extremely simple mechanism and procedure for effecting loom stoppage as a result of hot wire cutter failure.

With reference to the preferred embodiment of the invention illustrated in FIG. 2, the hot wire cutters 15 (which are electric resistance wires) are typically connected in series with a temperature control 16, transformer 17, and relay 18. Upon energization of the relay 18, the transformer 17 transforms 220 volt AC current from source 19 into low voltage, high current power (e.g. 4 volts AC 18 amperes), to effect operation of the cutter wires 15. The assembly of components 15, 16, 17, and 18 illustrated in FIG. 2 is commercially available, and one such assembly is the Thermocut TC1 Model maufactured by Loepfe Bros., Ltd.

Conventional looms also comprise a drop wire assembly 12, which typically includes a plurality of drop wires 21 and a knock-off solenoid 22. Each drop wire 21 typically comprises a piece of copper approximately $3.0 \times 0.5$ inches, with a slit in its center. A drop wire 21 is associated with each warp end on the loom 10, and each warp end is placed through a drop wire center slit as the loom is being prepared for weaving. When any warp end breaks, the drop wire 21 "drops" into contact with a common ground 23, causing operation of the solenoid 22. The assembly 12 is conventionally provided by the loom manufacturer, and typically the knock-off solenoids are supplied by Magnet A.G. The knock-off solenoid 22, when energized, stops operation of the loom by conventional means.

According to the present invention, the loom 10 also may be stopped as a result of burnout, or like failure, of a cutter wire 15, and in a manner such that the operator will know what the cause of loom stoppage was. This is preferably accomplished by providing a first electrical component 24 in series with the wire cutters 15, and a second electrical component 25, and an indicating means 26, in parallel with drop wires 21, with the component 25 operatively controlled by the component 24. In the preferred embodiment, as illustrated in the drawings, the first electrical component 24 comprises a coil which preferably consists of ten turns of number 12 (or greater) wire. Typically the coil may be approximately 1.5 inches long, 0.5 inches in diameter, and preferably has a hollow core approximately 0.25 inches in diameter. See FIG. 3, which shows the coil 24 with a hollow core 28.

The second electrical component 25 preferably comprises a conventional reed switch, which is dimensioned so that it fits within the core 28. The contacts 29 of the reed switch are preferably constructed so that they are biased to the closed position, but move to the open position (illustrated in FIG. 2) when the coil 24 is energized.

The indicating means 26 may comprise any conventional indicator, such as a visual or an audio indicator. In the preferred embodiment illustrated in the drawings, the indicator 26 comprises an electrically powered light source, such as a light bulb or LED. The reed switch and light source 26 are operatively connected between ground 30 and the knock-off solenoid 22.

According to the present invention, it is a simple matter to retrofit pre-existing looms, which almost always already have the hot wire cutter assembly 13 and the drop wire assembly 12. For instance the structure illustrated in FIG. 3 can be used for a retrofit. Suitable electrical connectors 32 may be provided on the ends of the wires forming the coil 24, and the electrical line including the hot wire cutters 15 may be severed and the ends thereof moved into operative association with the connectors 32. The electrical connector 33 may then merely be connected to electrical lead line between the drop wires 21 and the knock-off solenoid 22, and the electrical connector 34 (e.g. an alligator clip) may be connected to any suitable ground 30. Thus in a very simple way a conventional loom may be retrofit to effectively detect wire cutter failure.

OPERATION

A typical operation of the components according to the invention—with reference to FIG. 2—is as follows:

The transformer 17 and current source 19 provide a source of emf for the hot wire cutters 15, the transformer 17 transforming the power from source 19 to low voltage, high ampere. The temperature of the cutters 15 may be adjusted by the control 16. As long as current is flowing through all of the cutter wires 15, the coil 24 is energized, and the contacts 29 of the reed switch 25 are held in an "open" position.

Upon failure of one of the cutter wires 15, current is no longer supplied to the coil 24. When the coil 24 is de-energized, the contacts 29 of the reed switch 25 automatically move to the closed position. This allows a current path to be completed from the 12 volt power source through knock-off solenoid 22, indicator light 26, and reed switch 25 to ground 30. When the solenoid 22 is energized it automatically stops operation of the loom. Since light 26 is energized, the operator merely need inspect the light 26 and then will immediately know that cutter wire failure resulted in loom stoppage. The appropriate cutter wire 15 (or all cutter wires) may then be replaced.

According to the invention, the normal operation of the drop wires 21 to detect warp end breakage is not hindered in any way. When a warp end breaks, the drop wire 21 associated therewith will "drop" into contact with the common ground 23, again causing a current path to be completed between the 12 volt AC source, the solenoid 22, and ground 23. Again the loom is stopped. However in this situation since the indicator light 26 is not energized, the operator knows that the loom stoppage is not as a result of cutter wire failure but as a result of warp end breakage. The appropriate warp end will then be repaired.

It will thus be seen that according to the present invention loom stoppage as a result of cutter wire failure is simply and effectively ensured. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. In combination with a loom having a plurality of hot wire cutters for trimming selvage and the like, means for stopping operation of the loom in response to burnout, or like failure, of one of the cutter wires.

2. In a combination as recited in claim 1, a plurality of drop wires associated with said loom, and in operative engagement with warp ends associated with the loom; and means operatively associated with said drop wires for stopping operation of the loom upon warp end breakage; and wherein said means for stopping operation of said loom upon burnout of one of said cutter wires includes said loom stoppage means associated with said drop wires.

3. In a combination as recited in claim 2 wherein said means for stopping operation of said loom upon burnout of one of said cutter wires comprises a first electrical component operatively electrically connected to said cutter wires, and a second electrical component operatively connected in parallel with said drop wires, said first and second electrical components operatively interconnected together so that said first electrical component controls operation of said second electrical component.

4. In a combination as recited in claim 3 wherein said first electrical component comprises a coil, and wherein said second electrical component comprises a reed switch.

5. In a combination as recited in claim 4 further comprising indicating means operatively associated with said coil and said reed switch for indicating when said coil has actuated said reed switch to effect loom stoppage.

6. In a combination as recited in claim 5 wherein said indicating means comprises an electric light source connected in series with said reed switch, and wherein said reed switch includes contacts normally biased to a closed position, but movable to an open position when said coil is energized.

7. In a combination as recited in claim 1 circuitry means including said plurality of hot wire cutters, said circuitry means comprising a transformer, a relay, and a temperature control connected in series with said hot wire cutters; and wherein said means for stopping operation of said loom includes a first electrical component in series with said relay, transformer, temperature control, and hot wire cutters of said circuitry.

8. In a combination as recited in claim 7 wherein said first electrical component comprises a coil, and wherein said means for stopping operation of said loom further comprises a reed switch operatively associated with, and controlled by, said coil.

9. In a combination as recited in claim 8 wherein said coil includes a hollow core, and wherein said reed switch is mounted within said hollow core, and wherein the contacts of said reed switch are normally biased to a closed position and are operable upon energization of said coil to move to an open position.

10. In a combination as recited in claim 1 further comprising indicating means for indicating when said loom has been stopped by said means for stopping operation of said loom upon burnout of one of said cutter wires.

11. Electrical circuitry associated with an electrically powered device, and comprising:

a plurality of hot wire cutters;

a source of low voltage, high current emf; and means for terminating operation of the electrically powered device in response to burnout, or like failure, of one of said hot wire cutters.

12. Circuitry as recited in claim 11 wherein said means responsive to hot wire burnout comprises a first electrical component in series with hot wire cutters, and a second electrical component operatively associated with said first electrical component and controlled thereby.

13. Electrical circuitry means as recited in claim 12 wherein said first electrical component comprises a coil, and wherein said second electrical component comprises a reed switch.

14. Electrical circuitry as recited in claim 13 further comprising indicating means for indicating when said means responsive to hot wire cutter burnout has effected, or terminated, operation of the electrically powered device.

15. Electrical circuitry as recited in claim 14 wherein said indicating means comprises an electric light source connected in parallel with said reed switch, and wherein said reed switch includes contacts normally biased to a closed position, but movable to an open position when said coil is energized.

16. Electrical circuitry as recited in claim 13 wherein said coil has a hollow core, and wherein said reed switch is disposed in said hollow core.

17. A method of controlling operation of a loom having a plurality of hot wire cutters for trimming selvage, and a plurality of drop wires associated with warp ends and electrically connected to the loom to stop operation of the loom upon warp end breakage; comprising the step of:

operatively interconnecting the hot wire cutters with the pre-existing mechanism for stopping operation of the loom upon breakage of a warp end, so that stoppage of the loom is also effected upon burnout, or like failure, of one of the hot wire cutters.

18. A method as recited in claim 17 comprising the further step of providing for automatic indication of when loom stoppage is a result of hot wire cutter burnout, as opposed to warp end breakage or another event.

19. A method as recited in claim 18 wherein said steps are accomplished by providing a coil in series with the hot wire cutters, providing a reed switch in operative association with the coil, and providing the reed switch and an electrically powered indicating means connected in parallel with the drop wires.

20. A method as recited in claim 19 wherein the hot wire cutters and the drop wires are pre-existing structures on the loom, and wherein said providing steps are practiced by retrofitting the coil, reed switch, and indicating means thereto.

* * * * *